United States Patent [19]

Gilbert

[11] Patent Number: 4,909,650

[45] Date of Patent: Mar. 20, 1990

[54] PINE TAR APPLICATOR

[76] Inventor: Ronnie Gilbert, 6107 Yale, Amarillo, Tex. 79109

[21] Appl. No.: 183,079

[22] Filed: Apr. 19, 1988

Related U.S. Application Data

[63] Continuation-in-part of Ser. No. 756,951, Jul. 19, 1985, abandoned.

[51] Int. Cl.[4] ..... B05C 17/00; B05C 1/00

[52] U.S. Cl. ..... 401/196; 401/202; 401/285; 604/1; 15/104.94

[58] Field of Search ..... 401/6–8, 401/117, 183, 184, 196–199, 202, 205, 207, 268, 269, 283, 285, 126, 107, 129; 15/104.94, 209 R, 230.11, 230, 230.13, 230.14, 230.17, 244 R; 604/1, 2; 132/293; 101/38.1

[56] References Cited

U.S. PATENT DOCUMENTS

| | | | |
|---|---|---|---|
| 847,486 | 3/1907 | Mable . | |
| 1,062,961 | 5/1913 | Funcke | 401/126 X |
| 1,626,992 | 5/1927 | Willk . | |
| 2,490,650 | 12/1949 | Reckler . | |
| 2,653,575 | 9/1953 | Worden . | |
| 2,841,809 | 7/1958 | Oliver . | |
| 2,943,344 | 7/1960 | Reed . | |
| 3,229,321 | 1/1966 | Watts . | |
| 3,260,194 | 7/1966 | Karlyn | 101/38.1 |
| 3,554,657 | 1/1971 | Aston | 401/126 X |
| 3,712,748 | 1/1973 | Wilmans . | |
| 3,818,911 | 6/1974 | Fournier | 401/198 X |
| 3,936,198 | 2/1976 | Martin . | |
| 3,959,841 | 6/1976 | Horne . | |
| 3,966,334 | 6/1976 | Forsberg | 401/198 X |
| 4,084,286 | 4/1978 | Post . | |
| 4,135,274 | 1/1979 | Freeman | 401/196 X |
| 4,139,195 | 2/1979 | Dreesen et al. . | |
| 4,260,570 | 4/1981 | Ravel | 604/1 X |
| 4,276,718 | 7/1981 | Keeton et al. | 401/207 X |
| 4,396,028 | 8/1983 | Waggoner . | |
| 4,747,720 | 5/1988 | Bellehumeur et al. | 401/196 X |

FOREIGN PATENT DOCUMENTS

| | | | |
|---|---|---|---|
| 2500712 | 7/1976 | Fed. Rep. of Germany | 401/129 |
| 640746 | 1/1984 | Switzerland . | |
| 685054 | 12/1952 | United Kingdom | 401/129 |

OTHER PUBLICATIONS

The Condensed Chemical Dictionary, Hawley, Tenth Ed., Van Nostrand Reinhold Co., 1981, pp. 311, 818.

*Primary Examiner*—Richard J. Apley
*Assistant Examiner*—David J. Bender
*Attorney, Agent, or Firm*—Banner, Birch, McKie & Beckett

[57] ABSTRACT

The present invention relates to a pine tar applicator for applying pine tar to an athlete's hands and sports equipment to provide a more secure grip. The pine tar applicator includes an elongate chamber disposed between two end caps. Alternately, the pine tar applicator includes an absorbant foam roller disposed on an elongate support element. A sleeve slips over the chamber or support element and is sealed shut when the applicator is not in use. A fastener is provided at one end cap to allow the applicator to be conveniently hung from a backstop, fence or the like, providing easy access for the player.

17 Claims, 3 Drawing Sheets

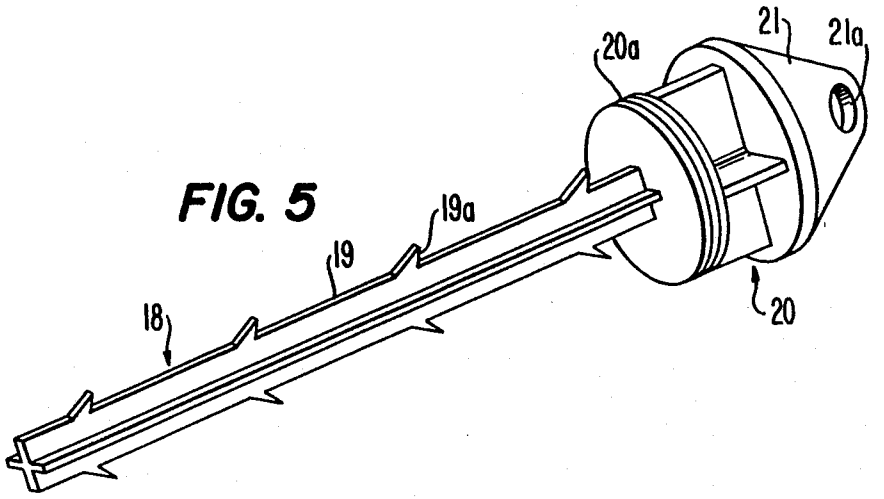
FIG. 5
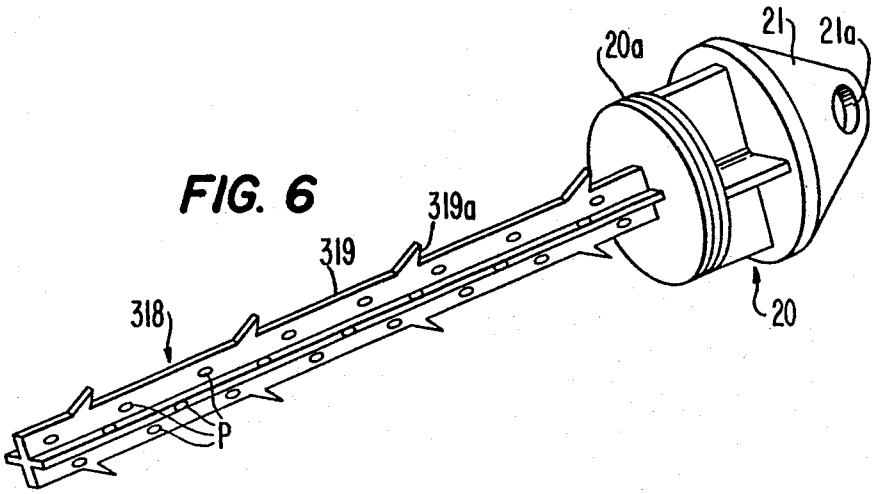
FIG. 6
FIG. 4
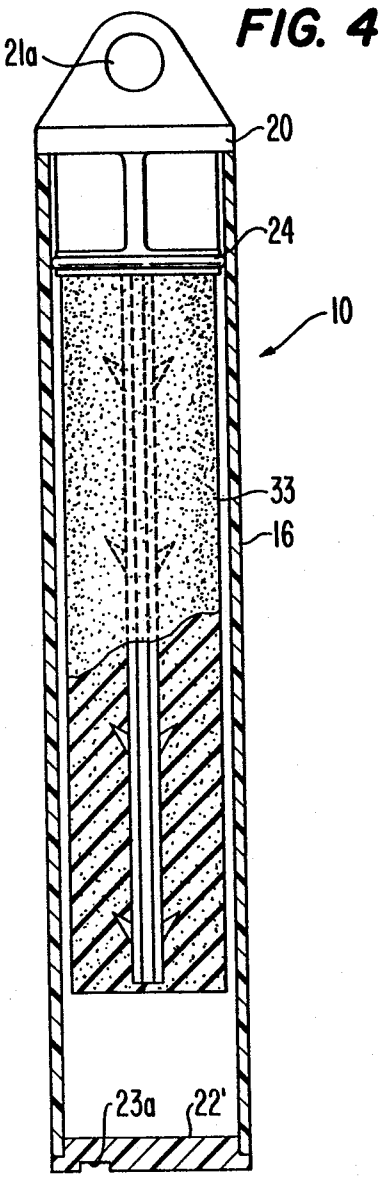

PINE TAR APPLICATOR

RELATED APPLICATION

This application is a continuation-in-part of Ser. No. 756,951, filed July 19, 1985, now abandoned.

TECHNICAL FIELD

The present invention relates to an applicator and, in particular, to a pine tar applicator for athletes to apply pine tar to their hands and sports equipment to insure a secure grip.

BACKGROUND OF THE INVENTION

Athletes, particularly softball and baseball players, need to maintain a secure grip of their sports equipment, such as a baseball bat. To facilitate this, players put pine tar on their hands and the bat handle to improve their grip. Usually a player merely soaks a cloth with pine tar and places it in a sealable plastic bag until needed. However, there are many disadvantages with this. The bags do not always seal well and the pine tar is not maintained fresh and pliable. This also allows pine tar to possibly get onto the player's clothes, car interior, etc. Moreover, it is easy to misplace the plastic bag with the pine tar cloth.

The pine tar applicator of the present invention overcomes the above disadvantages. The applicator is constructed so as to be airtight, thus maintaining the pine tar in a fresh and pliable condition. The applicator is self-contained and can be easily carried in a player's accessories bag without leaking pine tar onto the contents of the bag. The applicator is more visible than a plastic bag with a pine tar cloth and may be conveniently hung from a backstop or the like.

SUMMARY OF THE INVENTION

The present invention comprises a pine tar applicator which maintains the pine tar in a fresh and pliable condition. In one embodiment the applicator includes a pine tar reservoir held between two end caps. A sleeve fits over the reservoir and caps when the applicator is not in use. An eye bolt and snap fastener are attached to one end cap to allow the applicator to be conveniently hung from a backstop, fence, or the like. The reservoir may comprise a hollow, perforated barrel filled with pine tar, around which an absorbent pad or cloth is wrapped. Alternatively, the barrel may be unperforated and the cloth or pad may be soaked with pine tar before being wrapped around the barrel.

It is important that the sleeve be sealed over the reservoir when the applicator is not in use. To provide a preferred seal, the reservoir barrel may be in threaded engagement with both end caps. Additionally, a groove may be provided in each end cap, and an O-ring is disposed in the groove. Thus, when the sleeve is closed the O-rings form an airtight seal between the end caps and the sleeve.

In another embodiment, a pine tar retainer such as a foam roller is disposed on a rod. The rod has an end cap integrally formed therewith. This end cap has a groove for receiving an O-ring which seals between the end cap and one end of the sleeve. This end cap has a hole for receiving a snap fastener. A second end cap is removably disposed on one end of the sleeve for closing the other end of the sleeve.

In operation, the applicator may be hung on the backstop and the sleeve removed. A player squeezes the reservoir with one or both hands to apply pine tar to his hands. A bat handle may also be rolled across the reservoir to apply pine tar to the bat. When finished, the sleeve is replaced over the reservoir to keep the pine tar fresh and pliable.

Various advantages and features of novelty which characterize the invention are further pointed out with particularity in the claims that follow. However, for a better understanding of the invention, its advantages, and objects obtained by its use, reference should be made to the accompanying drawings and descriptive matter which illustrate and describe the preferred embodiment of this invention.

BRIEF DESCRIPTION OF THE DRAWINGS

FIG. 4 is a side view, partially in section, showing another embodiment of the pine tar applicator.

FIG. 5 is a perspective view of the rod and end cap of the pine tar applicator of FIG. 4.

FIG. 6 is a side view, partially in section, showing another embodiment of the pine tar applicator with an end cap as illustrated in FIGS. 4 and 5.

DETAILED DESCRIPTION OF THE DRAWINGS

Figure 1:
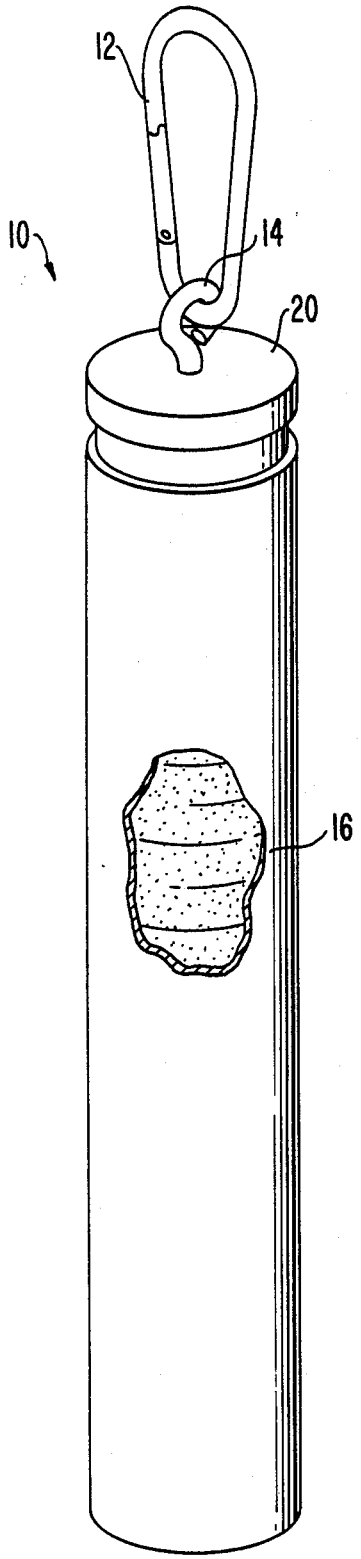
FIG. 1 is an isometric view of a pine tar applicator in accordance with the present invention.

A pine tar applicator according to the present invention is illustrated in FIG. 1 and generally designated as 10. Applicator 10 comprises elongate barrel 18, which is attached at each end to first and second end caps 20 and 22, respectively. Eye bolt 14 is attached to first end cap 20 and snap connector 12 is attached to eye bolt 14. Snap connector 12 allows applicator 10 to be conveniently hung from a backstop, fence, or the like. Sleeve 16 covers reservoir 34 when not in use.

Figure 2A:
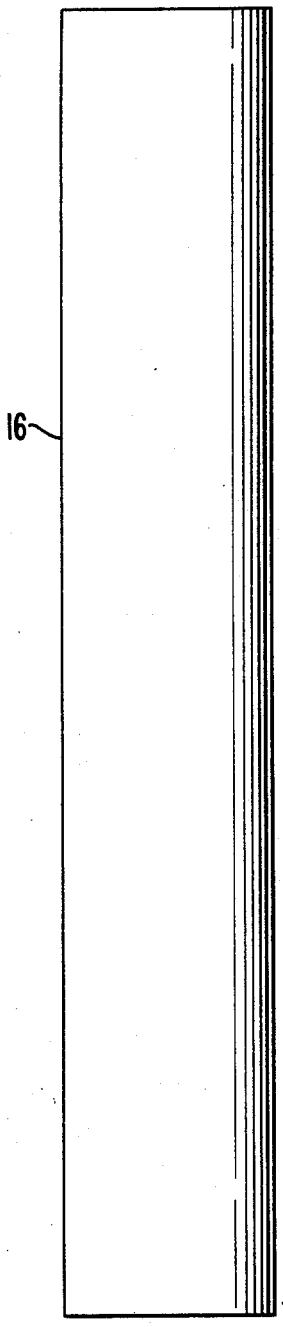
FIGS. 2A and 2B are side views of the sleeve and the applicator with the sleeve removed.
Figure 2B:
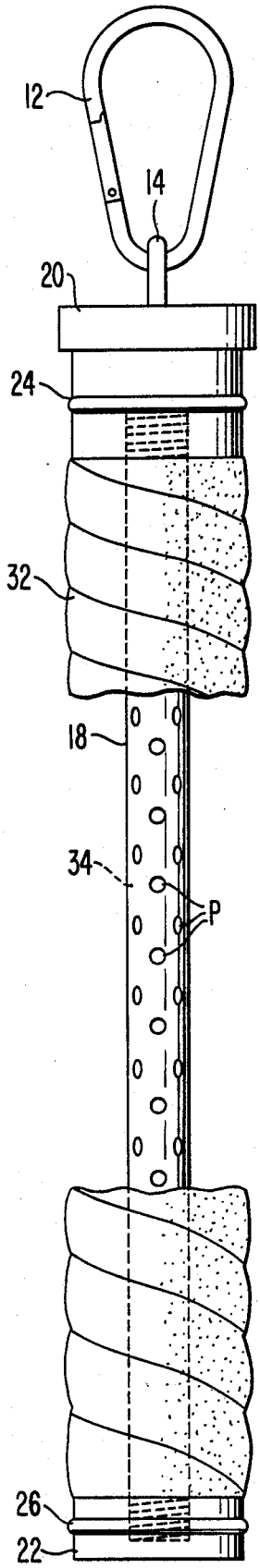

In the embodiment illustrated in FIGS. 2A and 2B, barrel 18 comprises elongated, perforated, hollow reservoir 34 filled with pine tar. Absorbent pad or cloth 32 is wrapped around reservoir 34. Alternatively, perforations may be eliminated from barrel 18 and cloth 32 is pre-soaked in pine tar and wrapped around barrel 18.

Barrel 18 may have threaded ends to coact with threads in first and second end caps 20, 22 to firmly engage barrel 18 within end caps 20, 22. Additionally, end caps 20, 22 may have circumferential grooves within which O-rings 24 and 26 are disposed. O-rings 24, 26 provide an airtight seal between end caps 20, 22 and sleeve 16. This seal assures that the pine tar is maintained fresh and pliable.

Figure 3A:
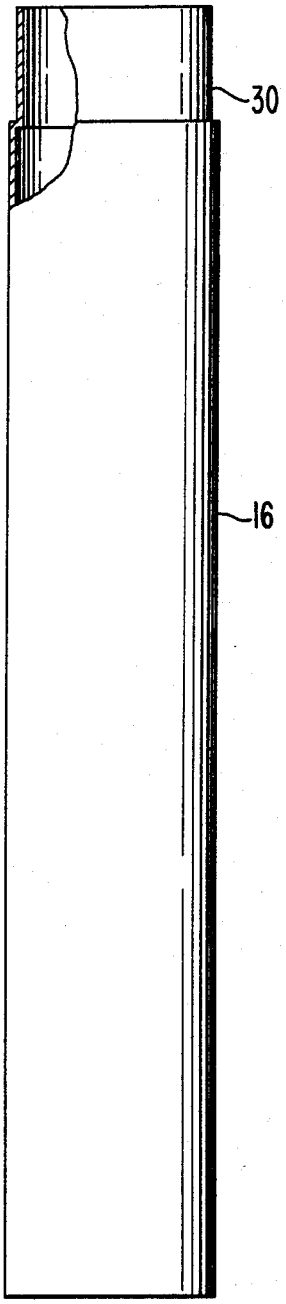
FIGS. 3A and 3B are side views of another embodiment of the sleeve and the applicator with the sleeve removed.
Figure 3B:
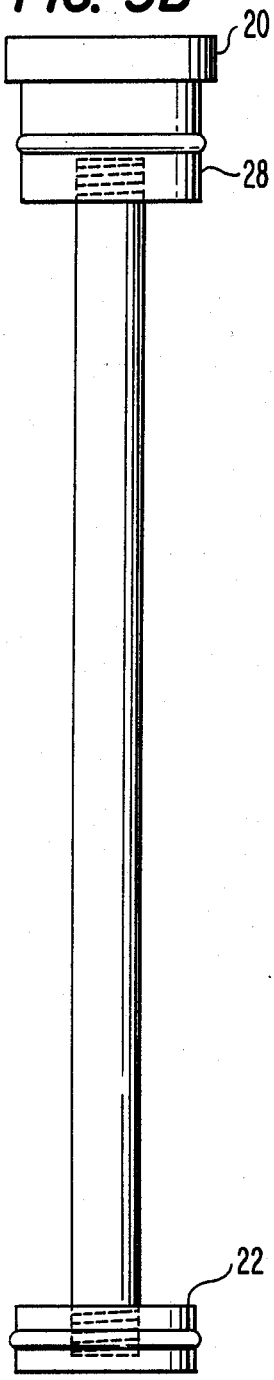

In another embodiment illustrated in FIGS. 3A and 3B, first end cap 20 has indented portion 28 having a smaller diameter than second end cap 22. Sleeve 16 has crimped portion 30 which snugly fits over indented portion 28 when sleeve 16 is in its closed position. Crimped portion 30 also has a smaller internal diameter than the external diameter of second end cap 22. When sleeve 16 is slid open to reveal cloth 32, crimped portion 30 cannot pass over second end cap 22 and sleeve 16 cannot be completely detached from the rest of applicator 10. This conveniently prevents the user from misplacing the sleeve while providing easy access to the pine tar cloth.

In another embodiment of pine tar applicator 10, shown in FIGS. 4 and 5, end cap 20 is integrally formed as part of barrel 118. End cap 20 is formed with a circumferential groove 20*a* which houses O-ring 24 which in turn forms a seal between end cap 20 and sleeve 16. Triangular-shaped projection 21 having hole 21*a* is formed at the top of end cap 20. Snap connector 12 may be attached to projection 21 through hole 21*a*. Barrel 118 is a preferably cross-shaped rod 19, and is not hollow. Rod 19 is formed with a series of barbs 19*a* for retaining a disposable, absorbant, pine tar retainer. In this embodiment, the pine tar retainer is cylindrically shaped foam roller 33. Foam roller 33 has an axial through hole and absorbs and retains pine tar. Foam roller 33 is slid onto rod 19 and is retained on rod 19 by barbs 19*a*.

End cap 22' is not formed as being connectable to rod 19. In this embodiment, end cap 22' is snap-actingly fitted within one end of sleeve 16. This facilitates cleaning the components of pine tar applicator 10. As in the other embodiments, end cap 22' could be formed with a circumferential groove for receiving O-ring 26 to facilitate sealing between end cap 22' and sleeve 16. End cap 22' may also be formed with a register or slot 22'*a* which permits the pine tar applicator to properly engage a machine that applies graphics on sleeve 16.

More specifically, the slot permits the stencilling or graphics machine to align the applicator therein so that, for example, more than one design or color may be applied sequentially to the applicator at the desired location. Such slot-like alignment mechanisms are known (see, e.g., U.S. Pat. No. 3,260,194 to Karlyn).

A further embodiment of the pine tar applicator is illustrated in FIG. 6 wherein perforated, hollow barrel 218 includes hollow cross-shaped rod 219 with barbs 219*a*.

Other minor modifications are clearly within the scope of the present invention. Hollow barrel 18, due to its threaded ends, could be constructed as a disposable pine tar cartridge. When a cartridge became empty, the user merely would discard it and replace it with a fresh cartridge. End caps 20, 22 could be provided with fluorescent tape or the like to aid the user in locating the applicator during night games.

Numerous characteristics and advantages of the invention have been set forth in the foregoing description, together with novel features and details of the structure and function of the invention. However, the disclosure is illustrative only and changes may be made in detail, especially in matters of shape, size and arrangement of parts, within the principle of the invention, to the full extent indicated by the broad general meaning of the terms in which the appended claims are expressed.

I claim:

1. A pine tar applicator for applying pine tar to the hands and sports equipment of an athlete to provide a more secure grip comprising:

an elongate support element comprising an elongate portion and a first substantially cylindrical end cap disposed on one end of said elongate portion and integrally formed therewith, said first end cap having a circumferential groove and fastening means for fastening said applicator to a support, and said elongate portion comprising a plurality of retaining barbs;

an elongate sleeve having first and second open ends, said sleeve being spaced from said support element to define an elongate chamber between said elongate portion of said support element and said sleeve, said sleeve being selectively movable between a closed position wherein said support element is covered by said sleeve and an open position wherein said sleeve is detached from said first end cap;

an O-ring seal disposed within said circumferential groove of said end cap to form a relatively airtight seal between said first end cap and the portion of said sleeve adjacent said first open end;

a second end cap removably and sealingly attachable to the second open end of said sleeve; and a disposable absorbent pine tar retainer which absorbs a quantity of pine tar, retains the pine tar until use, and applies the pine tar onto the hands or sports equipment of an athlete when rubbed thereagainst, said pine tar retainer being cylindrically shaped, capable of dispensing pine tar over a substantially 360° arc, and having a through axial bore, said pine tar retainer being slidable onto said elongate portion of said support element and being held thereon by said retaining barbs, and said first and second open ends being sized to permit the retainer to pass therethrough.

2. A pine tar applicator as set forth in claim 1 wherein said fastening means comprises a triangular-shaped projection formed together with said first end cap and having a hole, and a snap connector attached to said hole.

3. A pine tar applicator as set forth in claim 1 wherein said pine tar retainer comprises a foam roller.

4. A pine tar applicator as set forth in claim 1 wherein said second end cap comprises a slot for allowing said pine tar applicator to engage a graphics machine.

5. A pine tar applicator as set forth in claim 1 wherein said elongate portion of said elongate support element is substantially cross-shaped and said barbs are disposed on the ends of the cross portions of said elongate portion.

6. A pine tar applicator as set forth in claim 1 wherein said absorbent pine tar retainer is impregnated only with pine tar.

7. The pine tar applicator as set forth in claim 1 wherein said first substantially cylindrical end cap is closed at both ends.

8. The pine tar applicator as set forth in claim 1 wherein said second end cap is in the form of a disc having at least one substantially planar side surface.

9. The pine tar applicator as set forth in claim 8 wherein said second end cap comprises a slot formed in said at least one substantially planar side surface for allowing said pine tar applicator to engage a graphics machine.

10. A pine tar applicator for applying pine tar to the hands and sports equipment of an athlete to provide a more secure grip comprising:

an elongate support element comprising an elongate portion and a first substantially cylindrical end cap disposed on one end of said elongate portion and formed as one piece therewith, said first end cap having a circumferential groove and fastening means for fastening said applicator to a support, and said elongate portion comprising a hollow perforated barrel defining a reservoir, said barrel comprising a plurality of retaining barbs;

an elongate sleeve spaced from said support element to define an elongate chamber between said elongate portion of said support element and said sleeve, said sleeve being selectively movable between a closed position wherein said support element is covered by said sleeve and an open position;

an O-ring seal disposed within said circumferential groove of said first end cap to form a relatively airtight seal between said first end cap and one end of said sleeve;

a second end cap removably and sealingly attachable to the other end of said sleeve; and a disposable absorbent pine tar retainer which absorbs a quantity of pine tar from said reservoir and applies the pine tar onto the hands or sports equipment of an athlete when rubbed thereagainst, said pine tar retainer being cylindrically shaped, capable of dispensing pine tar over a substantially 360° arc, and having a through axial bore, said pine tar being slidable onto said elongate portion of said support element and being held thereon by said retaining barbs, and said first and second open ends being sized to permit the retainer to pass therethrough.

11. A pine tar applicator as set forth in claim 10 wherein said fastening means comprises a triangular-shaped projection formed together with said first end cap and having a hole, and a snap connector attached to said hole.

12. A pine tar applicator as set forth in claim 10 wherein said pine tar retainer comprises a foam roller.

13. A pine tar applicator as set forth in claim 10 wherein said second end cap comprises a slot for allowing said pine tar applicator to engage a graphics machine.

14. A pine tar applicator as set forth in claim 10 wherein said elongate portion of said elongate support element is substantially cross-shaped and said barbs are disposed on the ends of the cross portions of said elongate portion.

15. A pine tar applicator for applying pine tar to the hands and sports equipment of an athlete to provide a more secure grip comprising:

an elongate support element comprising an elongate portion and a first substantially cylindrical end cap disposed on one end of said elongate portion, said first end cap having a circumferential groove and fastening means for fastening said applicator to a support, and said elongate portion comprising a barrel having a plurality of retaining barbs;

an elongate sleeve spaced from said support element to define an elongate chamber between said elongate portion of said support element and said sleeve, said sleeve being selectively movable between a closed position wherein said support element is covered by said sleeve and an open position;

an O-ring seal disposed within said circumferential groove of said first end cap to form a relatively airtight seal between said first end cap and one end of said sleeve;

a second end cap removably and sealingly attachable to the other end of said sleeve; and a disposable absorbent pine tar retainer which absorbs a quantity of pine from said reservoir and applies the pine tar onto the hands or sports equipment of an athlete when rubbed thereagainst, said pine tar retainer being cylindrically shaped, capable of dispensing pine tar over a substantially 360° arc, and having a through axial bore, said pine tar being slidable onto said elongate portion of said support element and being held thereon by said retaining barbs, and said first and second open ends being sized to permit the retainer to pass therethrough.

16. The pine tar retainer of claim 15 wherein the end of said barrel opposite said first end cap is blunt.

17. The pine tar retainer of claim 16 wherein said elongate portion is substantially cross-shaped and said barbs are disposed on the ends of the cross portions of said elongate portion.

* * * * *

UNITED STATES PATENT AND TRADEMARK OFFICE

CERTIFICATE OF CORRECTION

PATENT NO. : 4,909,650

DATED : March 20, 1990

INVENTOR(S) : Ronnie Gilbert

It is certified that error appears in the above-identified patent and that said Letters Patent is hereby corrected as shown below:

The title page showing the illustrative figure should be deleted to appear as per attached title page.

Signed and Sealed this

Sixteenth Day of April, 1991

*Attest:*

*Attesting Officer*

HARRY F. MANBECK, JR.

*Commissioner of Patents and Trademarks*

United States Patent [19]

Gilbert

[11] Patent Number: 4,909,650

[45] Date of Patent: Mar. 20, 1990

[54] . PINE TAR APPLICATOR

[76] Inventor: Ronnie Gilbert, 6107 Yale, Amarillo, Tex. 79109

[21] Appl. No.: 183,079

[22] Filed: Apr. 19, 1988

Related U.S. Application Data

[63] Continuation-in-part of Ser. No. 756,951, Jul. 19, 1985, abandoned.

[51] Int. Cl.[4] ..... B05C 17/00; B05C 1/00

[52] U.S. Cl. ..... 401/196; 401/202; 401/285; 604/1; 15/104.94

[58] Field of Search ..... 401/6–8, 401/117, 183, 184, 196–199, 202, 205, 207, 268, 269, 283, 285, 126, 107, 129; 15/104.94, 209 R, 230.11, 230, 230.13, 230.14, 230.17, 244 R; 604/1, 2; 132/293; 101/38.1

[56] References Cited

U.S. PATENT DOCUMENTS

| | | | |
|---|---|---|---|
| 847,486 | 3/1907 | Mable . | |
| 1,062,961 | 5/1913 | Funcke | 401/126 X |
| 1,626,992 | 5/1927 | Willk . | |
| 2,490,650 | 12/1949 | Reckler . | |
| 2,653,575 | 9/1953 | Worden . | |
| 2,841,809 | 7/1958 | Oliver . | |
| 2,943,344 | 7/1960 | Reed . | |
| 3,229,321 | 1/1966 | Watts . | |
| 3,260,194 | 7/1966 | Karlyn | 101/38.1 |
| 3,554,657 | 1/1971 | Aston | 401/126 X |
| 3,712,748 | 1/1973 | Wilmans . | |
| 3,818,911 | 6/1974 | Fournier | 401/198 X |
| 3,936,198 | 2/1976 | Martin . | |
| 3,959,841 | 6/1976 | Horne . | |
| 3,966,334 | 6/1976 | Forsberg | 401/198 X |
| 4,084,286 | 4/1978 | Post . | |
| 4,135,274 | 1/1979 | Freeman | 401/196 X |
| 4,139,195 | 2/1979 | Dreesen et al. . | |
| 4,260,570 | 4/1981 | Ravel | 604/1 X |
| 4,276,718 | 7/1981 | Keeton et al. | 401/207 X |
| 4,396,028 | 8/1983 | Waggoner . | |
| 4,747,720 | 5/1988 | Bellehumeur et al. | 401/196 X |

FOREIGN PATENT DOCUMENTS

| | | | |
|---|---|---|---|
| 2500712 | 7/1976 | Fed. Rep. of Germany | 401/129 |
| 640746 | 1/1984 | Switzerland . | |
| 685054 | 12/1952 | United Kingdom | 401/129 |

OTHER PUBLICATIONS

The Condensed Chemical Dictionary, Hawley, Tenth Ed., Van Nostrand Reinhold Co., 1981, pp. 311, 818.

*Primary Examiner*—Richard J. Apley
*Assistant Examiner*—David J. Bender
*Attorney, Agent, or Firm*—Banner, Birch, McKie & Beckett

[57] ABSTRACT

The present invention relates to a pine tar applicator for applying pine tar to an athlete's hands and sports equipment to provide a more secure grip. The pine tar applicator includes an elongate chamber disposed between two end caps. Alternately, the pine tar applicator includes an absorbant foam roller disposed on an elongate support element. A sleeve slips over the chamber or support element and is sealed shut when the applicator is not in use. A fastener is provided at one end cap to allow the applicator to be conveniently hung from a backstop, fence or the like, providing easy access for the player.

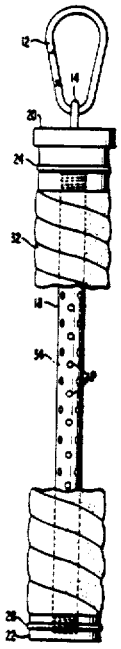

17 Claims, 3 Drawing Sheets